United States Patent [19]

Yagi et al.

[11] Patent Number: 4,932,859

[45] Date of Patent: Jun. 12, 1990

[54] ELECTROPHOTOGRAPHIC PHOTORECEPTOR HAVING DOPED AND/OR BILAYER AMORPHOUS SILICON PHOTOSENSITIVE LAYER

[75] Inventors: Shigeru Yagi; Masayuki Nishikawa; Te Nam Roh; Ken-ichi Karakida; Masahito Tokuhiro; Noriyoshi Takahashi; Yuzuru Fukuda, all of Kanagawa, Japan

[73] Assignee: Fuji Xerox Co., Ltd., Tokyo, Japan

[21] Appl. No.: 215,151

[22] Filed: Jul. 5, 1988

Related U.S. Application Data

[63] Continuation of Ser. No. 869,628, Jun. 2, 1986.

[30] Foreign Application Priority Data

| | | | |
|---|---|---|---|
| May 31, 1985 | [JP] | Japan | 60-118234 |
| May 31, 1985 | [JP] | Japan | 60-118235 |
| May 31, 1985 | [JP] | Japan | 60-118236 |
| May 31, 1985 | [JP] | Japan | 60-118237 |
| May 31, 1985 | [JP] | Japan | 60-118238 |
| May 31, 1985 | [JP] | Japan | 60-118239 |
| May 31, 1985 | [JP] | Japan | 60-118240 |
| May 31, 1985 | [JP] | Japan | 60-118241 |

[51] Int. Cl.[5] ..... G03G 5/14

[52] U.S. Cl. ..... 430/66; 430/57; 430/58; 430/67

[58] Field of Search ..... 430/57, 58, 66, 67

[56] References Cited

U.S. PATENT DOCUMENTS

| | | | |
|---|---|---|---|
| 4,544,617 | 10/1985 | Mort et al. | 430/67 X |
| 4,559,289 | 12/1985 | Sunagawa et al. | 430/67 X |
| 4,741,482 | 5/1988 | Iino et al. | 430/58 |

FOREIGN PATENT DOCUMENTS

| | | | |
|---|---|---|---|
| 57-114146 | 7/1982 | Japan | 430/66 |
| 60-61761 | 4/1985 | Japan | 430/66 |
| 60-225163 | 11/1985 | Japan | 430/65 |

*Primary Examiner*—Roland E. Martin

*Attorney, Agent, or Firm*—Sughrue, Mion, Zinn, MacPeak & Seas

[57] ABSTRACT

An electrophotographic photoreceptor having excellent dark resistance is disclosed, which comprises a photoconductive layer and a surface layer formed successively on a conductive substrate, wherein the photoconductive layer mainly comprises hydrogen-containing amorphous silicon, and the surface layer comprises amorphous carbon which contains not more than 50 atomic percent of hydrogen. The surface layer contains phosphorous or boron as a dopant and/or comprises two sublayers where the sublayer has a lower hydrogen content than the lower sublayer.

15 Claims, 1 Drawing Sheet

ELECTROPHOTOGRAPHIC PHOTORECEPTOR HAVING DOPED AND/OR BILAYER AMORPHOUS SILICON PHOTOSENSITIVE LAYER

This is a continuation of application Ser. No. 06/869,628 filed June 2, 1986, pending.

FIELD OF THE INVENTION

The present invention relates to an electrophotographic photoreceptor and, more particularly, to one having an amorphous silicon photosensitive layer.

BACKGROUND OF THE INVENTION

Electrophotography is a reprographic process comprising a charging step wherein a uniform charge is applied on the surface of a photoreceptor, an exposure step for providing a latent electrostatic image by imagewise exposure, a development step wherein the latent image is converted to a physical toner image with a developer, a transfer step wherein the toner image is transferred onto a receiving sheet, usually paper, and a fixing step wherein the toner pattern is permanently fixed to the sheet. The photoreceptor used in electrophotography consists basically of a photosensitive layer formed on an electroconductive substrate. The photosensitive layer comprises an inorganic light-sensitive material such as selenium or alloys thereof, cadmium sulfide or zinc oxide, or an organic light-sensitive material such as polyvinyl carbazole, trinitrofluorenone, bisazo pigments, phthalocyanine, pyrazoline or hydrazone. The photosensitive layer comprises one or more layers.

Photoreceptors using amorphous silicon photosensitive layers have recently been developed, and active efforts followed to improve them, as described in Japanese patent application (OPI) Nos. 78135/79 and 86341/79. Basically, the new type of photoreceptor consists of a conductive substrate on which is deposited an amorphous silicon film by glow-discharge decomposition of silane ($SiH_4$) gas, and the photoconductivity of the amorphous film originates from the hydrogen atoms trapped in the amorphous silicon film. The amorphous silicon photoreceptor has many advantages, such as the high surface hardness of the photosensitive layer which renders it resistant to scratching and wear, high heat resistance, high mechanical strength, and excellent spectral response properties as evidenced by high photosensitivity at wavelengths in the range of about 400 to 700 nm.

Modern laser beam printers using semiconductor lasers as light sources require electrophotographic photoreceptors which have high photosensitivity in the longer wavelength range up to approximately 800 nm. It is known that the optical band gap of an amorphous silicon photoreceptor can be decreased by doping amorphous silicon with a sufficient amount of germanium to form amorphous silicon-germanium as described in Japanese patent application (OPI) No. 190955/83. As the doping of germanium increases, the optical band gap decreases continuously from 1.7 eV (Eg of amorphous silicon) to approximately 1.1 eV (Eg of germanium). Therefore, by forming a photoconductive layer of a(amorphous)-$Si_{1-x}Ge_x$, photosensitive characteristics extended into the longer wavelength range can be obtained, enabling the fabrication of an electrophotographic photoreceptor having a good spectral response in the longer range up to about 800 nm.

Although amorphous silicon photoreceptors display excellent spectral response characteristics and have fairly high dark resistance, their dark resistance is not high enough to provide ideal photoreceptors. The amorphous silicon photosensitive layer undergoes a high degree of dark decay and charges of a satisfactorily high potential cannot be attained by charging a photoreceptor having this amorphous silicon photosensitive layer. If the amorphous silicon photoreceptor is subjected to the electrophotographic process comprising a charging step, an imagewise exposure step for the formation of an electrostatic latent image, and a subsequent development step, the surface charges on the photoreceptor will decay before imagewise exposure or even the charges on non-exposed areas will decay before the development step. Either factor presents difficulty in attaining the potential required for development.

Decay of the charge potential is also sensitive to ambient conditions, and a pronounced drop occurs in a hot and humid atmosphere. In addition, the charge potential will decrease gradually as a result of cyclic use of the photoreceptor. Copies obtained from a photoreceptor which has experienced a high degree of dark decay in charge potential have low image densities and are incapable of faithful halftone reproduction.

SUMMARY OF THE INVENTION

The principal object, therefore, of the present invention is to provide an electrophotographic photoreceptor which has high surface hardness, is highly resistant to wear and heat, exhibits high photosensitivity over a broad spectral region, and which yet experiences a low degree of dark decay in charge potential.

This object of the present invention is attained by an electrophotographic photoreceptor having a photoconductive layer and a surface layer formed successively on a conductive substrate, wherein said photoconductive layer mainly comprises hydrogen-containing amorphous silicon, and said surface layer comprises amorphous carbon which contains not more than 50 atomic percent of hydrogen.

The surface layer contains phosporous or boron as a dopant and/or comprises two sublayers where the upper sublayer has a lower hydrogen content than the lower sublayer.

DETAILED DESCRIPTION OF THE INVENTION

Figure 1:
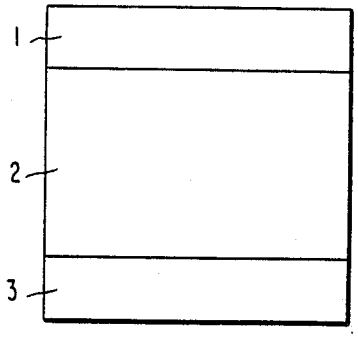
FIGS. 1 and 2 show two basic structures of the photoreceptor of the present invention.
Figure 2:
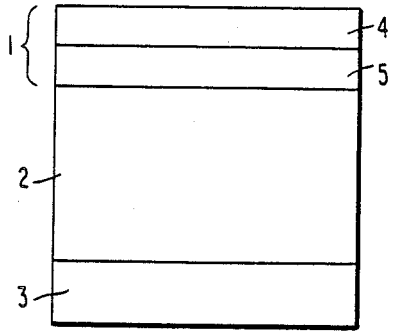

One basic structure of the electrophotographic photoreceptor of the present invention is shown in FIG. 1, wherein the numeral 1 is a surface layer which comprises amorphous carbon containing not more than 50 atomic % of hydrogen, 2 is a photoconductive layer which mainly comprises hydrogen-containing amorphous silicon, and 3 is a conductive substrate. As shown in FIG. 2, the surface layer may consist of two sublayers, the upper sublayer 4 and the lower sublayer 5.

The surface layer 1 serves as a charge blocking layer which prevents charges from penetrating into the bulk of the photoconductive layer during the charging step. The surface layer 1 also serves to protect the surface of the photoconductive layer by preventing direct contact or adsorption of molecular species such as oxygen, water vapor, moisture in the air and ozone ($O_3$) which prevail in the ambient atmosphere. Additionally, the surface layer 1 works as a surface protector which prevents the characteristics of the photoconductive layer from being impaired by the action of such external factors as stress application and deposition of reactive chemical substances.

Another function of the surface layer is to prevent escape of hydrogen and other film constituent atoms which prevail in the amorphous silicon-based photoconductive layer.

The surface layer 1 can be formed by any known thin-film forming technique such as glow-discharge decomposition, sputtering, ion plating, vacuum evaporation or chemical vapor deposition (CVD). The amorphous carbon film having not more than 50 atomic %, preferably 5 to 40 atomic %, of hydrogen based on the total atoms in the film which is formed by glow-discharge decomposition of a hydrocarbon compound has the high dark resistance, high transparency and high hardness required for use in an electrophotographic photoreceptor and yet will not sacrifice the inherent properties of the underlying amorphous silicon-based photoconductive layer.

The surface layer 1 in the photoreceptor of the present invention may be prepared from the following materials. Sources of carbon which is the main component of the surface layer include: (1) aliphatic hydrocarbons including paraffinic hydrocarbons represented by the general formula $C_nH_{2n+2}$ such as methane, ethane, propane, butane and pentane, olefinic hydrocarbons represented by the general formula $C_nH_{2n}$ such as ethylene, propylene, butene and pentene, and acetylenic hydrocarbons represented by the general formula $C_nH_{2n-2}$ such as acetylene, allylene, and butine, preferably those having 1 or 2 carbon atoms; (2) alicyclic hydrocarbons such as cyclopropane, cyclobutane, cyclopentane, cyclohexane, cycloheptane, cyclobutene, cyclopentene and cyclohexene, preferably those having 3 or 4 carbon atoms; and (3) aromatic hydrocarbons such as benzene, toluene, xylene, naphthalene and anthracene, preferably those having 6 to 9 carbon atoms. Of these, methane and ethane are particularly preferred.

Hydrogen is usually incorporated in the amorphous carbon film in the form of the hydrogen present in the hydrocarbon feed. But if desired, hydrogen gas may be introduced into the film-forming apparatus together with the hydrocarbon feed.

Figure 4:
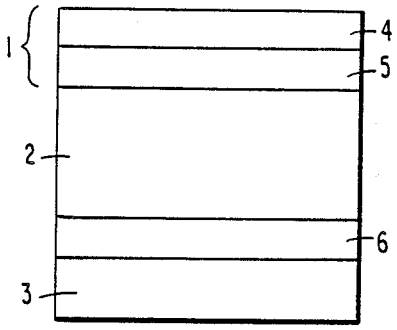

The surface layer 1 may be a single layer or a double layer. In the case of the double-layered structure as shown in FIGS. 2 and 4, the hydrogen content in the upper sublayer 4 is preferably lower than that in the lower sublayer 5, and the hydrogen content in the upper sublayer is preferably 40 atomic % or less, more preferably 10 to 30 atomic %, and the hydrogen content in the lower sublayer is preferably 50 atomic % or less, more preferably 20 to 40 atomic %. In general, as the hydrogen content in the surface layer increases, the charge potential of the photoreceptor is less decreased, but at the same time the surface hardness decreases. Therefore, while the object of the present invention can be attained by the lower sublayer alone, a photoreceptor having excellent surface hardness can be obtained by the formation of the upper sublayer having less hydrogen content on the lower sublayer.

The dark resistance of the amorphous carbon surface layer or the characteristics of its interface with the underlying amorphous silicon-based photoconductive layer may be controlled by mixing the feed gas with a dopant gas such as diborane ($B_2H_6$) gas or phosphine ($PH_3$) gas so that the surface layer is doped with an impurity element such as boron (B) or phosphorus (P) in an amount typically ranging from $10^{-4}$ to 1.0 atomic %, whereby the residual potential which tends to increase due to accumulation of charge on the surface layer after repeated use can be effectively minimized. The surface layer doped with boron or phosphorus may also have the double-layered structure. In the case, it is preferred that the dopant contents in the upper sublayer 4 and the lower sublayer 5 range from $10^{-4}$ to less than 1.0 atomic % and from 0.1 to 1.0 atomic %, respectively, provided that the dopant content in the upper sublayer 4 is lower than that in the lower layer, whereby the residual potential can be more effectively minimized.

The feed gas may be decomposed by glow discharge on a D.C. or A.C. supply, with the frequency of up to 30 MHz, preferably from 5 to 20 MHz. The equipment is evacuated to a pressure of 0.1 to 5 Torr (13.3 to 667 Pa), and the substrate is heated to a temperature between 100° and 400° C. The thickness of the surface layer 1 may be selected at any value but is preferably not greater than 10 μm, with 1 μm or less being particularly advantageous. When the surface layer 1 is composed of the upper sublayer and the lower sublayer, the thickness of each sublayer is generally 0.1 to 10 μm, preferably 0.2 to 5 μm, and more preferably 1 μm or less.

The amorphous silicon-based photoconductive layer 2 can be formed on the substrate by any known thin-film deposition technique such as glow-discharge decomposition, sputtering, ion plating, vacuum evaporation or CVD. An appropriate amount of hydrogen can be straightforwardly incorporated in the film by glow-discharge decomposition of silane ($SiH_4$) gas or a silane derivative in a reactor for the plasma-assisted CVD process and the resulting photoconductive layer has optimum characteristics suitable for use in an electrophotographic photoreceptor in that it has high dark resistance and photoconductivity. The amount of hydrogen in the photoconductive layer is generally 5 to 30 atomic % and preferably 10 to 30 atomic %. In order to ensure more efficient incorporation of hydrogen, hydrogen gas may be introduced into the reactor for the plasma-assisted CVD process together with the silane gas or silane derivative. Examples of silane derivatives include gases such as $Si_2H_6$, $Si_3H_8$, $Si_4H_{10}$, $SiCl_4$, $SiHCl_3$, $SiH_2Cl_2$ and $Si(CH_3)_4$.

Particularly preferable results are obtained by glow-discharge decomposition of silane gas or silane derivatives together with germanium tetrafluoride ($GeF_4$) gas: the spectral response of the resulting amorphous silicon-germanium-based photoconductive layer is extended to the longer wavelength side; the fluorine in the photoconductive layer helps increase its thermal stability and chemical resistance to oxygen, water vapor and ozone; the layer has sufficiently high dark resistance and photosensitivity to be suitable for use in an electrophotographic photoreceptor. By using germanium tetrafluoride gas, both germanium and fluorine can be incorporated in amorphous silicon in an efficient manner. The content of germanium in the photoconductive layer is preferably 5 to 30 atomic %.

The dark resistance of the amorphous silicon-based photoconductive film or the polarity of its charging may be controlled by mixing the feed gas with a dopant gas such as diborane gas or phosphine gas so that the photoconductive layer is doped with an impurity element such as boron or phosphorus in an amount typically ranging from $10^{-4}$ to 1.0 atomic %. Furthermore, in order to increase the dark resistance or photosensitivity of the film or its chargeability (charge potential per unit film thickness), halogen, carbon, oxygen or nitrogen atoms may be incorporated in the amorphous silicon-based film, as described in Japanese patent application (OPI) Nos. 83746/81, 145540/79, 145539/79 and 100131/83.

These non-hydrogen elements may be incorporated in the amorphous silicon-based photoconductive layer by glow-discharge decomposition of gaseous compounds of these elements which are introduced into the reactor for the plasma-assisted CVD process together with the silane gas or silane derivatives supplied as the principal feed material.

When the amorphous silicon-based photoconductive layer is formed by A.C. glow-discharge decomposition of silane gas or silane derivatives in a reactor for the plasma-assisted CVD process, the following discharging conditions may be effectively employed in order to form the desired amorphous silicon-based film: the frequency ranges typically from 0.1 to 30 MHz, preferably from 5 to 20 MHz; the reactor is evacuated to 0.1 to 5 Torr during discharging; and the substrate is heated to a temperature of 100° to 400° C.

The thickness of the amorphous silicon-based photoconductive layer 2 may be selected at any value but is preferably in the range of 1 to 200 μm, with 10 to 100 μm being particularly advantageous.

The conductive substrate shown at 3 in FIGS. 1 to 4 may be made of a metal such as Al, Ni, Cr, Fe, stainless steel or brass; alternatively, the substrate may be of an intermetallic compound such as $In_2O_3$, $SnO_2$, CuI or $CrO_2$. The substrate may assume any form, such as a cylinder or endless belt.

Figure 3:
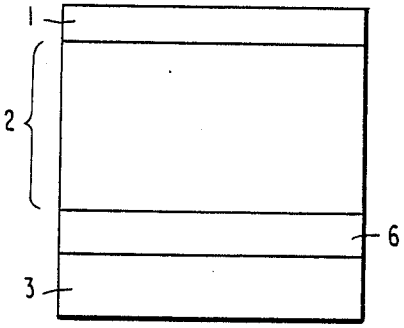
FIGS. 3 and 4 show two embodiments of the photoreceptor incorporating a charge injection blocking layer in accordance with the present invention.

If desired, a charge injection blocking layer 6 may be provided at the interface between the photoconductive layer 2 and the conductive substrate 3 as shown in FIGS. 3 and 4. The thickness of the layer 6 is generally 0.2 to 5 μm. The material of the layer 6 depends on whether the photoreceptor is to be charged negatively or positively, and a suitable material is hydrogenated amorphous silicon doped with a trace amount of boron or phosphorus, e.g., $5\times10^{-3}$ to 0.5 atomic % of boron or $1\times10^{-3}$ to 0.1 atomic % of phosphorus.

The present invention is hereunder described with reference to working examples as contrasted with comparative examples.

COMPARATIVE EXAMPLE 1

An "intrinsic" amorphous silicon-based film with comparatively high dark resistance which contained hydrogen and a trace level of boron was formed on a cylindrical Al substrate by glow-discharge decomposition of a mixture of silane gas and diborane gas in a parallel-plate reactor for the plasma-assisted CVD process. The following conditions were used for the formation of the amorphous Si-based film.

The cylindrical Al substrate was set on a predetermined position in the reactor. While the substrate was heated at a predetermined temperature (250° C.), the reactor was continuously charged with 100% silane gas, hydrogendiluted 100-ppm diborane gas and 100% hydrogen gas at rates of 120 ml, 20 ml and 90 ml per minute, respectively. After the pressure in the reactor was adjusted to 0.5 Torr, a radio-frequency (13.56 MHz) power was supplied to produce a glow discharge, with the r-f power output maintained at 85 watts. The resulting photoreceptor consisted of a 25 μm-thick "intrinsic" amorphous Si-based photoconductive layer of high dark resistance which contained hydrogen and ppm-order boron and which was deposited on the cylindrical Al substrate.

The photoreceptor was positively charged to an initial potential of 550 volts, and subsequently exposed to light at a wavelength of 650 nm. Periodic cycles of recharging and exposure were repeated at a rate of 40 cycles per minute. The residual potential was stable at zero volts but the charge potential had a tendency to decrease with the increasing number of cycles and, after 1,000 cycles, the charge potential dropped to 75% of the initial value.

Similar results were obtained when the photoreceptor was subjected to periodic negative charging and exposure under the same conditions. In addition, the resolution of the image obtained by performing electrophotography with the photoreceptor decreased with cyclic operations.

COMPARATIVE EXAMPLE 2

A p-type amorphous Si-based film containing hydrogen and a trace amount of boron and an "intrinsic" amorphous Si-based film containing hydrogen and a trace amount of boron were successively formed on a cylindrical Al substrate by glow-discharge decomposition of a mixture of silane gas and diborane gas in the same apparatus as used in Comparative Example 1. The following conditions were employed in forming the two amorphous silicon-based layers.

The cylindrical Al substrate was set on a predetermined position in the reactor. While the substrate was heated at a predetermined temperature (250° C.), the reactor was continuously charged with 100% silane gas, hydrogendiluted 100-ppm diborane gas and 100% hydrogen gas at rates of 120 ml, 100 ml and 90 ml per minute, respectively. After the pressure in the reactor was adjusted to 0.5 Torr, a radio-frequency (13.56 MHz) power was supplied to produce a glow discharge, with the r-f power output maintained at 85 watts. As a result, a 0.2 μm-thick p-type amorphous Si-based film containing both hydrogen and boron was deposited on the cylindrical Al substrate.

Then, the reactor was continuously charged with 100% silane gas, hydrogen-diluted 100-ppm diborane gas and 100% hydrogen gas at rates of 120 ml, 20 ml and 90 ml per minute, respectively. After the pressure in the reactor was adjusted to 0.5 Torr, glow discharge was conducted as in the deposition of the p-type amorphous Si-based layer. As a result, a photoreceptor was produced wherein a 25 μm-thick "intrinsic" amorphous Si-based layer with hydrogen and ppm-order boron was formed on the p-type amorphous Si-based layer.

The photoreceptor thus prepared was set in an electrophotographic copying machine and copies were reproduced using the positively corona-charged photoreceptor. Initially, image densities which were satisfactory for practical purposes were attained but, as a result of cyclic copying operations, the image density decreased gradually.

COMPARATIVE EXAMPLE 3

An "intrinsic" amorphous photoconductive film with high dark resistance which was principally composed of silicon and germanium and which contained hydrogen and fluorine and ppm-order boron was formed on a cylindrical Al substrate by glow-discharge decomposition of a mixture of silane gas and 10% germanium tetrafluoride gas in a parallel-plate reactor for the plasma-assisted CVD process. The following conditions were employed for the formation of the amorphous photoconductive film.

The cylindrical Al substrate was set on a predetermined position in the reactor. While the substrate was heated at a predetermined temperature (250° C.), the reactor was continuously charged with a mixture of silane gas and 10% germanium tetrafluoride gas, hydrogen-diluted 100-ppm diborane gas and 100% hydrogen gas at rates of 120 ml, 20 ml and 90 ml per minute, respectively. After the pressure in the reactor was adjusted to 0.5 Torr, a radio-frequency (13.56 MHz) power was supplied to produce a glow discharge, with the r-f power output maintained at 85 watts. The resulting photoreceptor consisted of the Al substrate carrying a 25 μm-thick "intrinsic" amorphous photoconductive layer of high dark resistance which was chiefly composed of silicon and germanium and which contained hydrogen and fluorine and ppm-order boron.

The photoreceptor had high surface hardness, exhibited high wear and heat resistance and its dark resistance and photoconductivity were high enough to make the photoreceptor highly suitable for use in electrophotography. In addition, the photoreceptor was capable of being charged both positively and negatively.

The photoreceptor was positively charged to an initial potential of 550 volts, and subsequently exposed to light at a wavelength of 78O nm. Periodic cycles of charging and exposure were repeated at a rate of 40 cycles per minute. The residual potential was stable at zero volts but the charge potential had a tendency to decrease with the increasing number of cycles and, after 1,000 cycles, the charge potential dropped to 75% of the initial value.

Similar results were obtained when the photoreceptor was subjected to periodic negative charging and exposure under the same conditions. In addition, the resolution of the image obtained by performing electrophotography with this photoreceptor decreased with cyclic operations.

COMPARATIVE EXAMPLE 4

A p-type amorphous Si-based film containing both hydrogen and a trace amount of boron and an "intrinsic" amorphous photoconductive film which was principally composed of silicon and germanium and which also contained hydrogen, fluorine and ppm-order boron were successively formed on a cylindrical Al substrate by glow-discharge decomposition in the same reactor as used in Comparative Example 3. The following conditions were employed in forming the two amorphous silicon-based layers.

The cylindrical Al substrate was set on a predetermined position in the reactor. While the substrate was heated at a predetermined temperature (250° C.), the reactor was continuously charged with 100% silane gas, hydrogendiluted 100-ppm diborane gas and 100% hydrogen gas at rates of 120 ml, 100 ml and 90 ml per minute, respectively. After the pressure in the reactor was adjusted to 0.5 Torr, a radio-frequency (13.56 MHz) power was supplied to produce a glow discharge, with the r-f power output maintained at 85 watts. As a result, a 0.2 μm-thick p-type amorphous Si-based film containing hydrogen and a trace amount of boron was deposited on the cylindrical Al substrate.

Then, the reactor was continuously charged with a mixture of silane gas and 10% germanium tetrafluoride gas, hydrogen-diluted 100-ppm diborane gas and 100% hydrogen gas at respective of 120 ml, 20 ml and 90 ml per minute, respectively. After the pressure in the reactor was adjusted to 0.5 Torr, glow discharge was conducted as in the deposition of the p-type amorphous Si-based layer. As a result, a photoreceptor was produced wherein a 25 μm-thick "intrinsic" amorphous Si-Ge-based layer with fluorine and ppm-order boron was formed on the p-type amorphous Si-based layer.

The so prepared photoreceptor had high surface hardness, exhibited high wear and heat resistance, and its dark resistance and photoconductivity were high enough to make the photoreceptor highly suitable for use in electrophotography.

This photoreceptor was set in an electrophotographic copying machine and copies were reproduced using the positive corona-charged photoreceptor. Initially, image densities which were satisfactory for practical purposes were attained but, as a result of cyclic copying operations, the image density decreased gradually.

COMPARATIVE EXAMPLE 5

The procedures of Comparative Example 1 were repeated except that the supply rate of hydrogen-diluted 100-ppm diborane gas was increased to 100 ml/min. The resulting photoreceptor consisted of a cylindrical Al substrate carrying thereon a 25 μm-thick "intrinsic" amorphous Si-based photoconductive layer with high dark resistance which contained hydrogen and ppm-order boron.

This photoreceptor was positively charged to an initial potential of 550 volts, and subsequently exposed to light at a wavelength of 650 nm. Periodic charging and exposure were repeated at a rate of 40 cycles per minute. The residual potential was stable at zero volts but the charge potential had a tendency to decrease with the increasing number of cycles and, after 1,000 cycles, the charge potential fell to 70% of the initial value.

Similar results were obtained when the photoreceptor was subjected to periodic negative charging and exposure under the same conditions. In addition, the resolution of the image obtained by performing electrophotography with this photoreceptor decreased with cyclic operations.

EXAMPLE 1

An amorphous Si-based photoconductive layer was formed by the same method and under the same conditions as employed in Comparative Example 5. Thereafter, the reactor was evacuated and supplied with a mixture of methane gas and 0.5% phosphine gas at a rate of 50 ml/min. to increase the pressure in the reactor to 0.2 Torr. By glow-discharge decomposition of the gaseous mixture, a 0.3 μm-thick surface layer which was made of amorphous carbon containing about 40 atomic % of hydrogen and 0.1 atomic % of phosphorus was deposited on the photoconductive layer.

This surface layer had high surface hardness and exhibited excellent wear resistance, transparency and heat resistance.

The photoreceptor consisting of the amorphous carbon surface layer and the amorphous Si-based photoconductive layer on the Al substrate was positively charged to an initial potential of 550 volts, and subsequently exposed to light at a wavelength of 650 nm. Periodic cycles of charging and exposure were repeated at a rate of 40 cycles per minute. The residual potential was stable at 10 volts and the charge potential after 1,000 cycles was as high as 90% of the initial value. Electrophotography was performed on the same photoreceptor and even after 1,000 cycles of duplication, a copy having excellent image density and resolution was obtained.

EXAMPLE 2

After an amorphous Si-based photoconductive layer was formed by the same method and under the same conditions as employed in Comparative Example 2, the reactor was evacuated and supplied with a mixture of ethane gas and 0.2% diborane gas at a rate of 20 ml/min. to increase the pressure in the reactor to 0.1 Torr. By glow-discharge decomposition of the gaseous mixture, a 0.1 μm-thick surface layer which was made of amorphous carbon containing 30 atomic % of hydrogen and 0.05 atomic % of boron was deposited on the photoconductive layer.

This surface layer had high surface hardness and exhibited excellent wear resistance, transparency and heat resistance.

The photoreceptor comprising the amorphous carbon surface layer and the amorphous Si-based photoconductive layer on the Al substrate was set in an electrophotographic copying machine and copies were reproduced using the positively corona-charged photoreceptor. Initially, image densities which were satisfactory for practical purposes were attained, and $5\times10^4$ copies could be reproduced without experiencing any drop in image density.

EXAMPLE 3

After an amorphous Si-based photoconductive layer was formed by the same method and under the same conditions as employed in Comparative Example 2, the reactor was evacuated and supplied with a mixture of ethylene gas and 0.7% phosphine ($PH_3$) gas at a rate of 30 ml/min. to increase the pressure in the reactor to 0.1 Torr. By glow-discharge decomposition of the gaseous mixture, a 0.2 μm-thick surface layer which was made of amorphous carbon containing 30 atomic % of hydrogen and 0.2 atomic % of phosphorus was deposited on the photoconductive layer.

This surface layer had high surface hardness and exhibited excellent wear resistance, transparency and heat resistance.

The photoreceptor comprising the amorphous carbon surface layer and the amorphous Si-based photoconductive layer on the Al substrate was set in an electrophotographic copying machine and copies were reproduced using the positively corona-charged photoreceptor. Initially, image densities which were satisfactory for practical purposes were attained and $5\times10^4$ copies could be reproduced without experiencing any drop in image density.

EXAMPLE 4

An amorphous Si-Ge-based photoconductive layer was formed by the same method and under the same conditions as employed in Comparative Example 3. Therefore, the reactor was evacuated and supplied with a mixture of methane gas and 0.5% diborane gas at a rate of 50 ml/min. to increase the pressure in the reactor to 0.2 Torr. By glow-discharge of the gaseous mixture, a 0.3 μm-thick surface layer which was made of amorphous carbon containing 40 atomic % hydrogen and 0.1 atomic % of boron was deposited on the photoconductive layer.

This surface layer had high surface hardness and exhibited excellent wear resistance, transparency and heat resistance.

The photoreceptor consisting of the amorphous carbon surface layer and the amorphous Si-Ge-based photoconductive layer on the Al substrate was positively charged to an initial potential of 550 volts, and subsequently exposed to light at a wavelength of 780 nm. Periodic cycles of charging and exposure were repeated at a rate of 40 cycles per minute. The residual potential after 100 cycles was stable at 20 volts and the charge potential after 1,000 cycles was as high as 98% of the initial value.

Electrophotography was performed on the same photoreceptor and even after 1,000 cycles of duplication, a copy having excellent image density and resolution was obtained.

EXAMPLE 5

After an amorphous Si-Ge-based photoconductive layer was formed by the same method and procedures and under the same conditions as employed in Comparative Example 4, the reactor was evacuated and supplied with a mixture of ethane gas and 0.3% phosphine gas at a rate of 20 ml/min. to increase the pressure in the reactor to 0.1 Torr. By glow-discharge decomposition of the gaseous mixture, a 0.1 μm-thick surface layer which was made of amorphous carbon containing 30 atomic % of hydrogen and 0.1 atomic % of phosphorus was deposited on the photoconductive layer.

This surface layer had high surface hardness and exhibited excellent wear resistance, transparency and heat resistance.

The photoreceptor comprising the amorphous carbon surface layer and the amorphous Si-Ge-based photoconductive layer on the Al substrate was set in an electrophotographic copying machine and copies were reproduced using the positively corona-charged photoreceptor. Initially, image densities which were satisfactory for practical purposes were attained, and $5\times10^4$ copies could be reproduced without experiencing any drop in image density.

EXAMPLE 6

After an amorphous Si-Ge-based photoconductive layer was formed by the same method and procedures and under the same conditions as employed in Comparative Example 4, the reactor was evacuated and supplied with a mixture of ethylene gas and 0.3% diborane gas at a rate of 30 ml/min. to increase the pressure in the reactor to 0.1 Torr. By glow-discharge decomposition of the gaseous mixture, a 0.2 μm-thick surface layer which was made of amorphous carbon containing 30 atomic % of hydrogen and 0.05 atomic % of boron was deposited on the photoconductive layer.

This surface layer had high surface hardness and exhibited excellent wear resistance, transparency and heat resistance.

The photoreceptor comprising the amorphous carbon surface layer and the amorphous Si-Ge-based photoconductive layer on the Al substrate was set in an electrophotographic copying machine and copies were reproduced using the positively corona-charged photoreceptor. Initially, image densities which were satisfactory for practical purposes were attained, and $5\times10^4$ copies could be reproduced without experiencing any drop in image density.

EXAMPLE 7

After an amorphous Si-based photoconductive layer was formed by the same method and under the same conditions as employed in Comparative Example 2, the reactor was evacuated and supplied with a mixture of ethane gas and 20 ppm diborane gas at a rate of 20 ml/min. to increase the pressure in the reactor to 0.1 Torr. By glow-discharge decomposition of the mixture, 0.1 μm-thick surface layer which was made of amorphous carbon containing 30 atomic % of hydrogen and $1\times10^{-3}$ atomic % of boron was deposited on the photoconductive layer.

This surface layer had high surface hardness and exhibited excellent wear resistance, transparency and heat resistance.

The photoreceptor comprising the amorphous carbon surface layer and the amorphous Si-based photoconductive layer on the Al substrate was set in an electrophotographic copying machine and copies were reproduced using the positively corona-charged photoreceptor. Initially, image densities which were satisfactory for practical purposes were attained, and $5\times10^4$ copies could be reproduced without experiencing any drop in image density.

EXAMPLE 8

After an amorphous Si-based photoconductive layer was formed by the same method and under the same conditions as employed in Comparative Example 2, the reactor was evacuated and supplied with a mixture of ethylene gas and 50 ppm diborane gas at a rate of 30 ml/min. to increase the pressure in the reactor to 0.1 Torr. By glow-discharge of the mixture, a 0.2 μm-thick surface layer which was made of amorphous carbon containing 30 atomic % hydrogen and $2\times10^{-3}$ atomic % of boron was deposited on the photoconductive layer.

This surface layer had high surface hardness and exhibited excellent wear resistance, transparency and heat resistance.

The photoreceptor comprising the amorphous carbon surface layer and the amorphous Si-based photoconductive layer on the Al substrate was set in an electrophotographic copying machine and copies were reproduced using the positively corona-charged photoreceptor. Initially, image densities which were satisfactory for practical purposes were attained, and $5\times10^4$ copies could be reproduced without experiencing any drop in image density.

EXAMPLE 9

An amorphous Si-Ge-based photoconductive layer was formed by the same method and under the same conditions as employed in Comparative Example 3. Therefore, the reactor was evacuated and supplied with a mixture of methane gas and 10 ppm diborane gas at a rate of 50 ml/min. to increase the pressure in the reactor to 0.2 Torr. By glow-discharge of the gaseous mixture, a 0.3 μm-thick surface layer which was made of amorphous carbon containing 40 atomic % hydrogen and $5\times10^{-4}$ atomic % of boron was deposited on the photoconductive layer.

This surface layer had high surface hardness and exhibited excellent wear resistance, transparency and heat resistance.

The photoreceptor consisting of the amorphous carbon surface layer and the amorphous Si-Ge-based photoconductive layer on the Al substrate was positively charged to an initial potential of 550 volts, and subsequently exposed to light at a wavelength of 780 nm. Periodic cycles of charging and exposure were repeated at a rate of 40 cycles per minute. The residual potential after 100 cycles was stable at 20 volts and the charge potential after 1,000 cycles was as high as 98% of the initial value.

Electrophotography was performed on the same photoreceptor and even after 1,000 cycles of duplication, a copy having excellent image density and resolution was obtained.

EXAMPLE 10

After an amorphous Si-Ge-based photoconductive layer was formed by the same method and procedures and under the same conditions as employed in Comparative Example 4, the reactor was evacuated and supplied with a mixture of ethane gas and 20 ppm diborane gas at a rate of 20 ml/min. to increase the pressure in the reactor to 0.1 Torr. By glow-discharge decomposition of the gaseous mixture, a 0.1 μm-thick surface layer which was made of amorphous carbon containing 30 atomic % of hydrogen and $1\times10^{-3}$ atomic % of boron was deposited on the photoconductive layer.

This surface layer had high surface hardness and exhibited excellent wear resistance, transparency and heat resistance.

The photoreceptor comprising the amorphous carbon surface layer and the amorphous Si-Ge-based photoconductive layer on the Al substrate was set in an electrophotographic copying machine and copies were reproduced using the positively corona-charged photoreceptor. Initially, image densities which were satisfactory for practical purposes were attained, and $5\times10^4$ copies could be reproduced without experiencing any drop in image density.

EXAMPLE 11

After an amorphous Si-Ge-based photoconductive layer was formed by the same method and procedures and under the same conditions as employed in Comparative Example 4, the reactor was evacuated and supplied with a mixture of ethylene gas and 50 ppm diborane gas at a rate of 30 ml/min. to increase the pressure in the reactor to 0.1 Torr. By glow-discharge decomposition of the mixture, a 0.2 μm-thick surface layer which was made of amorphous carbon containing 30 atomic % of hydrogen and $2\times10^{-3}$ atomic % of boron was deposited on the photoconductive layer.

This surface layer had high surface hardness and exhibited excellent wear resistance, transparency and heat resistance.

The photoreceptor comprising the amorphous carbon surface layer and the amorphous Si-Ge-based photoconductive layer on the Al substrate was set in an electrophotographic copying machine and copies were reproduced using the positively corona-charged photoreceptor. Initially, image densities which were satisfactory for practical purposes were attained, and $5\times10^4$ copies could be reproduced without experiencing any drop in image density.

EXAMPLE 12

An amorphous Si-based photoconductive layer was formed by the same method and under the same conditions as employed in Comparative Example 1. Therefore, the reactor was evacuated and supplied with a mixture of methane gas and 0.5% diborane gas at a rate of 50 ml/min. to increase the pressure in the reactor to 0.2 Torr. By glow-discharge decomposition of the gaseous mixture, a 0.3 μm-thick surface layer which was made of amorphous carbon containing about 40 atomic % of hydrogen and 0.06 atomic % of boron was deposited on the photoconductive layer.

Subsequently, the reactor was continuously charged with a mixture of methane gas and 10 ppm diborane gas at a rate of 50 ml/min. to increase the pressure in the reactor to 0.2 Torr. By glow-discharge decomposition of the mixture, a 0.1 μm-thick surface layer which was made of amorphous carbon containing 40 atomic % of hydrogen and $1\times10^{-4}$ atomic % of boron was deposited on the previously prepared 0.3 μm-thick surface layer.

The resulting double-layered surface layer had high surface hardness and exhibited excellent wear resistance, transparency and heat resistance.

The photoreceptor consisting of the amorphous carbon surface layer and the amorphous Si-based photoconductive layer on the Al substrate was positively charged to an initial potential of 550 volts, and subsequently exposed to light at a wavelength of 650 nm. Periodic cycles of charging and exposure were repeated at a rate of 40 cycles per minute. The residual potential was stable at 10 volts and the charge potential after 1,000 cycles was as high as 98% of the initial value. Electrophotography was performed on the same photoreceptor and even after 1,000 cycles of duplication, a copy having excellent image density and resolution was obtained.

EXAMPLE 13

After an amorphous Si-based photoconductive layer was formed by the same method and under the same conditions as employed in Comparative Example 2, the reactor was evacuated and supplied with a mixture of ethane gas and 0.2% diborane gas at a rate of 20 ml/min. to increase the pressure in the reactor to 0.1 Torr. By glow-discharge decomposition of the mixture, 0.1 μm-thick surface layer which was made of amorphous carbon containing 30 atomic % of hydrogen and 0.01 atomic % of boron was deposited on the photoconductive layer.

Subsequently, the reactor was continuously charged with a mixture of ethane gas and 20 ppm diborane gas at a rate of 20 ml/min. to increase the pressure in the reactor to 0.1 Torr. By glow-discharge decomposition of the mixture, a 0.2 μm-thick surface layer which was made of amorphous carbon containing 30 atomic % of hydrogen and $7\times10^{-4}$ atomic % of boron was deposited on the previously prepared 0.1 μm-thick surface layer.

The resulting double-layered surface layer had high surface hardness and exhibited excellent wear resistance, transparency and heat resistance.

The photoreceptor comprising the amorphous carbon surface layer and the amorphous Si-based photoconductive layer on the Al substrate was set in an electrophotographic copying machine and copies were reproduced using the positively corona-charged photoreceptor. Initially, image densities which were satisfactory for practical purposes were attained, and $5\times10^4$ copies could be reproduced without experiencing any drop in image density.

EXAMPLE 14

After an amorphous Si-based photoconductive layer was formed by the same method and procedures and under the same conditions as employed in Comparative Example 2, the reactor was evacuated and supplied with a mixture of ethylene gas and 0.2% diborane gas at a rate of 30 ml/min. to increase the pressure in the reactor to 0.1 Torr. By glow-discharge of the mixture, a 0.2 μm-thick surface layer which was made of amorphous carbon containing 30 atomic % hydrogen and 0.01 atomic % of boron was deposited on the photoconductive layer.

Subsequently, the reactor was continuously charged with a mixture of ethylene gas and 30 ppm diborane gas at a rate of 30 ml/min. to raise the pressure in the reactor to 0.1 Torr. By glow-discharge decomposition of the mixture, a 0.2 μm-thick surface layer which was made of amorphous carbon containing 30 atomic % of hydrogen and $2\times10^{-4}$ atomic % of boron was deposited on the previously prepared 0.2 μm-thick surface layer.

The resulting double-layered surface layer had high surface hardness and exhibited excellent wear resistance, transparency and heat resistance.

The photoreceptor comprising the amorphous carbon surface layer and the amorphous Si-based photoconductive layer on the Al substrate was set in an electrophotographic copying machine and copies were reproduced using the positively corona-charged photoreceptor. Initially, image densities which were satisfactory for practical purposes were attained, and $5\times10^4$ copies could be reproduced without experiencing any drop in image density.

EXAMPLE 15

An amorphous Si-Ge-based photoconductive layer was formed by the same method and under the same conditions as employed in Comparative Example 3. Therefore, the reactor was evacuated and supplied with a mixture of methane gas and 0.2% diborane gas at a rate of 50 ml/min. to increase the pressure in the reactor to 0.2 Torr. By glow-discharge of the mixture, a 0.1 μm-thick surface layer which was made of amorphous carbon containing 40 atomic % hydrogen and 0.02 atomic % of boron was deposited on the photoconductive layer.

Subsequently, the reactor was continuously charged with a mixture of methane gas and 20 ppm diborane gas at a rate of 50 ml/min. to raise the pressure in the reactor to 0.2 Torr. By glow-discharge decomposition of the mixture, a 0.3 μm-thick surface layer which was made of amorphous carbon containing 40 atomic % of hydrogen and $2\times10^{-4}$ atomic % of boron was deposited on the previously prepared 0.1 μm-thick surface layer.

The resulting double-layered surface layer had high surface hardness and exhibited excellent wear resistance, transparency and heat resistance.

The photoreceptor consisting of the amorphous carbon surface layer and the amorphous Si-Ge-based photoconductive layer on the Al substrate was positively charged to an initial potential of 550 volts, and subsequently exposed to light at a wavelength of 780 nm. Periodic cycles of charging and exposure were repeated at a rate of 40 cycles per minute. The residual potential was stable at 10 volts and the charge potential after 1,000 cycles was as high as 98% of the initial value.

Electrophotography was performed on the same photoreceptor and even after 1,000 cycles of duplication, a copy having excellent image density and resolution was obtained.

EXAMPLE 16

After an amorphous Si-Ge-based photoconductive layer was formed by the same method and procedures and under the same conditions as employed in Comparative Example 4, the reactor was evacuated and supplied with a mixture of ethane gas and 0.3% diborane gas at a rate of 20 ml/min. to increase the pressure in the reactor to 0.1 Torr. By glow-discharge decomposition of the mixture, a 0.1 μm-thick surface layer which was made of amorphous carbon containing 30 atomic % of hydrogen and 0.02 atomic % of boron was deposited on the photoconductive layer.

Subsequently, the reactor was continuously charged with a mixture of ethane gas and 40 ppm diborane gas at a rate of 20 ml/min. to raise the pressure in the reactor to 0.1 Torr. By glow-discharge decomposition of the mixture, a 0.2 μm-thick surface layer which was made of amorphous carbon containing 30 atomic % of hydrogen and $3\times10^{-4}$ atomic % of boron was deposited on the previously prepared 0.1 μm-thick surface layer.

The resulting double-layered surface layer had high surface hardness and exhibited excellent wear resistance, transparency and heat resistance.

The photoreceptor comprising the amorphous carbon surface layer and the amorphous Si-Ge-based photoconductive layer on the Al substrate was set in an electrophotographic copying machine and copies were reproduced using the positively corona-charged photoreceptor. Initially, image densities which were satisfactory for practical purposes were attained, and $5\times10^4$ copies could be reproduced without experiencing any drop in image density.

EXAMPLE 17

After an amorphous Si-Ge-based photoconductive layer was formed by the same method and procedures and under the same conditions as employed in Comparative Example 4, the reactor was evacuated and supplied with a mixture of ethylene gas and 0.3% diborane gas at a rate of 30 ml/min. to increase the pressure in the reactor to 0.1 Torr. By glow-discharge decomposition of the mixture, a 0.1 μm-thick surface layer which was made of amorphous carbon containing 30 atomic % of hydrogen and 0.02 atomic % of boron was deposited on the photoconductive layer.

Subsequently, the reactor was continuously charged with a mixture of ethylene gas and 30 ppm diborane gas at a rate of 30 ml/min. to raise the pressure in the reactor to 0.1 Torr. By glow-discharge decomposition of the mixture, a 0.1 μm-thick surface layer which was made of amorphous carbon containing 30 atomic % of hydrogen and $2\times10^{-4}$ atomic % of boron was deposited on the previously prepared 0.1 μm-thick surface layer.

The resulting double-layered surface layer had high surface hardness and exhibited excellent wear resistance, transparency and heat resistance.

The photoreceptor comprising the amorphous carbon surface layer and the amorphous Si-Ge-based photoconductive layer on the Al substrate was set in an electrophotographic copying machine and copies were reproduced using the positively corona-charged photoreceptor. Initially, image densities which were satisfactory for practical purposes were attained, and $5\times10^4$ copies could be reproduced without experiencing any drop in image density.

EXAMPLE 18

After an amorphous Si-Ge-based photoconductive layer was formed by the same method and under the same conditions as employed in Comparative Example 4, the reactor was evacuated and supplied with ethylene gas at a rate of 20 ml/min. to increase the pressure in the reactor to 0.5 Torr. By glow-discharge decomposition of ethylene, a 0.1 μm-thick surface layer which was made of amorphous carbon containing about 40 atomic % of hydrogen was deposited on the photoconductive layer.

Subsequently, the reactor was continuously charged with methane gas at a rate of 10 ml/min. to increase the pressure in the reactor to 0.2 Torr. By glow-discharge decomposition of methane, a 0.2 μm-thick surface layer which was made of amorphous carbon containing 30 atomic % of hydrogen was deposited on the previously prepared 0.1 μm-thick surface layer.

The resulting double-layered surface layer had high surface hardness and exhibited excellent wear resistance, transparency and heat resistance.

The photoreceptor comprising the amorphous carbon surface layer and the amorphous Si-Ge-based photoconductive layer on the Al substrate was positively charged to an initial potential of 550 volts, and subsequently exposed to light at a wavelength of 780 nm. Periodic cycles of charging and exposure were repeated at a rate of 40 cycles per minute. The residual potential was stable at 10 volts and the charge potential after 1,000 cycles was as high as 99% of the initial value.

EXAMPLE 19

After an amorphous Si-based photoconductive layer was formed by the same method and under the same conditions as employed in Comparative Example 2, the reactor was evacuated and supplied with ethylene gas at a rate of 20 ml/min. to increase the pressure in the reactor to 0.5 Torr. By glow-discharge decomposition of ethylene, 0.1 μm-thick surface layer which was made of amorphous carbon containing 40 atomic % of hydrogen was deposited on the photoconductive layer.

Subsequently, the reactor was continuously charged with methane gas at a rate of 10 ml/min. to increase the pressure in the reactor to 0.2 Torr. By glow-discharge decomposition of methane, a 0.2 μm-thick surface layer which was made of amorphous carbon containing 30 atomic % of hydrogen was deposited on the previously prepared 0.1 μm-thick surface layer.

The resulting double-layered surface layer had high surface hardness and exhibited excellent wear resistance, transparency and heat resistance.

The photoreceptor comprising the amorphous carbon surface layer and the amorphous Si-based photoconductive layer on the Al substrate was positively charged to an initial potential of 550 volts, and subsequently exposed to light at a wavelength of 650 nm. Periodic cycles of charging and exposure were repeated at a rate of 40 cycles per minute. The residual potential was stable at 10 volts and the charge potential after 1,000 cycles was as high as 99% of the initial value.

As will be apparent from the foregoing description and experimental data, the present invention provides an electrophotographic photoreceptor which experiences minimum dark decay of surface charges and which yet retains the inherent advantageous characteristics of the amorphous silicon employed in the photosensitive layer. In addition, germanium and fluorine can be effectively incorporated in the amorphous silicon by means of using germanium tetrafluoride gas as a component of the feed gas for the production of an amorphous silicon-based film. A photoreceptor using the so prepared amorphous silicon-based film as the photosensitive layer is advantageous in that it has an extended spectral response.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor having a photoconductive layer and a surface layer formed thereon successively on a conductive substrate, wherein said photoconductive layer mainly comprises hydrogen-containing amorphous silicon, and said surface layer consists essentially of amorphous carbon which contains from 5 to 50 atomic percent of hydrogen, and said surface layer is formed in contact with said photoconductive layer, said surface layer containing boron or phosphorus as a dopant.

2. An electrophotographic photoreceptor having a photoconductive layer and a surface layer formed successively on a conductive substrate, wherein said photoconductive layer mainly comprises hydrogen-containing amorphous silicon and said surface layer consists essentially of amorphous carbon which contains not more than 50 atomic percent of hydrogen, and said surface layer is formed in contact with said photoconductive layer, wherein said surface layer is composed of two sublayers, the upper sublayer containing a lower hydrogen content than the hydrogen content in the lower sublayer, wherein both the upper sublayer and the lower sublayer contain some hydrogen.

3. An electrophotographic photoreceptor according to claim 2 wherein said surface layer contains boron or phosphorus as a dopant.

4. An electrophotographic photoreceptor according to claim 1 wherein said dopant is present in an amount of $10^{-4}$ to 1.0 atomic %.

5. An electrophotographic photoreceptor according to claim 3 wherein said dopant is present in an amount of $10^{-4}$ to 1.0 atomic %.

6. An electrophotographic photoreceptor according to claim 1 wherein said surface layer is composed of two sublayers, the upper sublayer containing said dopant in an amount of from $10^{-4}$ atomic percent to less than 1.0 atomic %, and the lower sublayer containing said dopant in an amount of 0.1 to 1.0 atomic %, provided that the content of said dopant in the upper sublayer is lower than that in the lower sublayer.

7. An electrophotographic photoreceptor according to claim 3 wherein said surface layer is composed of two sublayers, the upper sublayer containing said dopant in an amount of from $10^{-4}$ atomic percent to less than 1.0 atomic %, and the lower sublayer containing said dopant in an amount of 0.1 to 1.0 atomic percent, provided that the content of said dopant in the upper layer is lower than that in the lower sublayer.

8. An electrophotographic photoreceptor according to claim 6 wherein said dopant is boron.

9. An electrophotographic photoreceptor according to claim 7 wherein said dopant is boron.

10. An electrophotographic photoreceptor according to claim 1 wherein said surface layer is composed of two sublayers, the upper sublayer containing a lower hydrogen content than the hydrogen content in the lower sublayer.

11. An electrophotographic photoreceptor according to claim 2 wherein the hydrogen content in said upper sublayer is 40 atomic % or less and the hydrogen content in said lower sublayer is 50 atomic % or less.

12. An electrophotographic photoreceptor according to claim 10 wherein the hydrogen content in said upper sublayer is 40 atomic % or less and the hydrogen content in said lower sublayer is 50 atomic % or less.

13. An electrophotographic photoreceptor according to claim 2 wherein the hydrogen content in said upper sublayer is 10 to 30 atomic % and the hydrogen content in said lower sublayer is 20 to 40 atomic %.

14. An electrophotographic photoreceptor according to claim 10 wherein the hydrogen content in said upper sublayer is 10 to 30 atomic % and the hydrogen content in said lower sublayer is 20 to 40 atomic%.

15. An electrophotographic photoreceptor according to claim 2, wherein the two sublayers as a whole contain 5 to 50 atomic percent hydrogen.

* * * * *